US008607978B2

(12) United States Patent
Bradford et al.

(10) Patent No.: US 8,607,978 B2
(45) Date of Patent: Dec. 17, 2013

(54) CONTAINER HAVING STATIONARY SUPPORT MEMBERS FOR SUPPORTING DUNNAGE

(75) Inventors: Judson A. Bradford, Holland, MI (US); Allen L. Burns, Holland, MI (US); Mark J. Feenstra, Grand Haven, MI (US); Eric S. Bruinsma, Holland, MI (US)

(73) Assignee: Bradford Company, Holland, MI (US)

( * ) Notice: Subject to any disclaimer, the term of this patent is extended or adjusted under 35 U.S.C. 154(b) by 70 days.

(21) Appl. No.: 13/303,538

(22) Filed: Nov. 23, 2011

(65) Prior Publication Data

US 2013/0126383 A1 May 23, 2013

(51) Int. Cl.
*B65D 85/68* (2006.01)

(52) U.S. Cl.
USPC ..... 206/335; 206/425; 220/23.88

(58) Field of Classification Search
USPC ..... 206/425, 593, 335, 372, 373, 386; 220/4.01, 529, 507, 503, 535, 495.01, 220/23.83, 23.88, 23.87
See application file for complete search history.

(56) References Cited

U.S. PATENT DOCUMENTS

| | | | | |
|---|---|---|---|---|
| 3,980,196 | A * | 9/1976 | Paulyson et al. | 220/1.5 |
| 4,400,107 | A * | 8/1983 | Pitts | 402/4 |
| 4,527,694 | A * | 7/1985 | Bolt et al. | 211/46 |
| 5,813,566 | A * | 9/1998 | Bradford et al. | 220/653 |
| 6,202,884 | B1 * | 3/2001 | Verkerke | 220/530 |
| 6,352,157 | B1 * | 3/2002 | Srinivasan | 206/425 |
| 6,464,092 | B1 * | 10/2002 | Kortman et al. | 211/194 |
| 6,719,157 | B2 * | 4/2004 | Stoddart et al. | 211/118 |
| 7,150,374 | B1 * | 12/2006 | Camps | 220/9.1 |
| 2006/0081490 | A1 * | 4/2006 | Bradford et al. | 206/386 |
| 2010/0072085 | A1 * | 3/2010 | Nyeboer et al. | 206/175 |

* cited by examiner

*Primary Examiner* — Jacob K Ackun
*Assistant Examiner* — Jenine Pagan
(74) *Attorney, Agent, or Firm* — Wood, Herron & Evans, LLP

(57) ABSTRACT

The present invention provides a container for holding product therein during shipment and being returned for reuse that has a body including at least one frame, holders supported by the body and a plurality of stationary support members extending between the holders. Each support member may be fixed in a stationary position by the holders. The support members support dunnage for supporting product for storage or shipment.

20 Claims, 14 Drawing Sheets

CONTAINER HAVING STATIONARY SUPPORT MEMBERS FOR SUPPORTING DUNNAGE

FIELD OF THE INVENTION

The present invention relates to containers for use in shipping and, more particularly, to containers with stationary members for supporting dunnage for receiving product.

BACKGROUND OF THE INVENTION

Different container structures are utilized by manufacturers to ship a variety of different products to end users, which may be, for example, assembly plants. In the automobile industry, for example, an assembly plant assembling a particular automobile might utilize a number of different parts from different manufacturers. These manufacturers ship their respective parts to the assembly plant in container structures where the parts are then removed from dunnage or support members inside the container structure and assembled into a finished automobile.

Access to the product in the containers is of particular concern. Specifically, in the automotive industry, the containers full of product are positioned on an assembly line adjacent to a work area which is associated with a particular product to be installed on a manufactured vehicle. For example, a container full of interior door panels is usually positioned next to a particular station on an assembly line where interior door panels are installed so that a line worker may easily access the door panels inside the container. The product or part is taken directly from the container and used on the line. Some existing containers are difficult to access which makes removal of the parts therein difficult and time consuming. For example, some containers are configured so that a line worker must walk around the container to remove parts or products from opposite ends of the container. As may be appreciated, a line worker only has a certain amount of time to install a part. Any delay in access and removal of the part from the container is undesirable.

In many containers, a line worker or employee must insert or remove parts from a distal or rear part of the container. The size and/or weight of the parts or workpieces may cause stress or strain on the line worker and, more particularly, on the back of the worker when inserting or removing parts from such a container. Such ergonomically unfriendly movements may cause physical trauma, pain and other injuries that may lead to lost production time.

In some situations, in order to alleviate such stress and/or strain on his or her body, the line worker may move to the rear or opposite end of the container to remove parts from inside the container. This requires space around the container which may not be available, depending on the physical layout of the plant or facility. The length (front to back) of certain containers may be limited because the container manufacturer needs to eliminate the need for a line worker to walk around the container to remove product from inside the container. Such containers having a reduced length reduce the number of parts or products which may be shipped and/or stored in the container. The more containers needed to ship a predetermined number of parts, the greater the cost to the shipper.

In containers having multiple layers or level of parts, a line worker or employee must lean forward and bend down into the container to insert or remove a part or workpiece from the bottom of the container. This movement by the line worker is ergonomically unfriendly because the line worker must lean forward and bend down into the container to insert or remove a part or workpiece from the bottom of the container. This movement is necessary with many top loading containers.

Depending upon the number of times the line worker repeats this unnatural motion, strain in the back, legs and arms may result. The size and/or weight of the parts or workpieces may increase the strain on the line worker. Thus, simply removing multiple parts during a work day may cause physical trauma, pain and other injuries that may lead to lost production time.

In known containers having one or more levels or layers of dunnage, such as pouches, a pocket may be sewn at the upper edges of each side of each pouch and sized to receive a rod or support member. The support member may have end members secured to opposed ends of the support member. The end members may roll or move in tracks secured to the sides of the container. Such sewing adds to the cost of the pouch or dunnage and, therefore, to the cost of the container. The rollers or end members add additional cost to the assembled container and present an opportunity for failure due to fatigue/wear.

Accordingly, there is a need for a container which has one or more layers of dunnage therein which may be assembled without the dunnage being sewn to its support members.

There is further a need for a container which has dunnage therein which may be assembled without the need for end members like rollers.

SUMMARY OF THE INVENTION

The present invention provides a container for holding product therein during shipment that has a body having a bottom, two sides and a rear. The container further comprises a frame extending between the sides of the body. The container further comprises a front holder supported by the frame and a rear holder supported by the body, in particular, the rear. The container further comprises a plurality of support members generally inside the container. The support members may be tubular, but may be partially or entirely solid in any of the embodiments shown or described. They may comprise multiple pieces and assume other shapes or configurations other than those shown in any of the embodiments shown or described.

The container further comprises dunnage supported by the support members. The dunnage may comprise pouches or any other known form of dunnage. The dunnage may be suspended from the support members without the need for any sewing. The dunnage, i.e., each of the pouches, may be slotted so as to allow support members to be woven through the slots in the dunnage without the need for sewing, although sewing may be utilized in specific areas of the pouch.

According to another aspect of the invention, the container for holding product therein during shipment has a body having a bottom and a rear structure and at least two side structures extending upwardly from the bottom. The container further comprises a front frame secured to side structures of the body. The container further comprises a front holder secured to a portion of the front frame and a rear holder supported by the body. The container further comprises a plurality of support members extending between and supported by the holders. According to one aspect of the invention, the support members may be tubular, but may assume other cross-sectional configurations. The container further comprises dunnage supported by the support members. The dunnage may comprise pouches or any other known form of dunnage. The dunnage may be suspended from the support member without the need for any sewing, although sewing may be utilized in specific areas of the pouch. The pouches may be formed from one piece of material which may be slotted so as to allow the support members to be woven through the slots in the dunnage without the need for sewing.

According to another aspect of the invention, the container for holding product therein during shipment has a body having a bottom and at least two side structures. The container further comprises front and rear rectangular frames supported by and extending between the side structures. The container further comprises holders secured to the frames and a plurality of support members extending between the holders. The container further comprises dunnage supported by the support members. According to one aspect of the invention, the support members may be tubular, but may be other desired configurations. The dunnage may comprise pouches or any other known form of dunnage. The dunnage may be suspended from the support member without the need for any sewing. The pouches or dunnage may be slotted so as to allow one of the support members to be woven through the slots in the dunnage without the need for sewing, although sewing may be utilized in specific areas of the pouch.

The above and other objects and advantages of the present invention shall be made apparent from the accompanying drawings and the brief description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
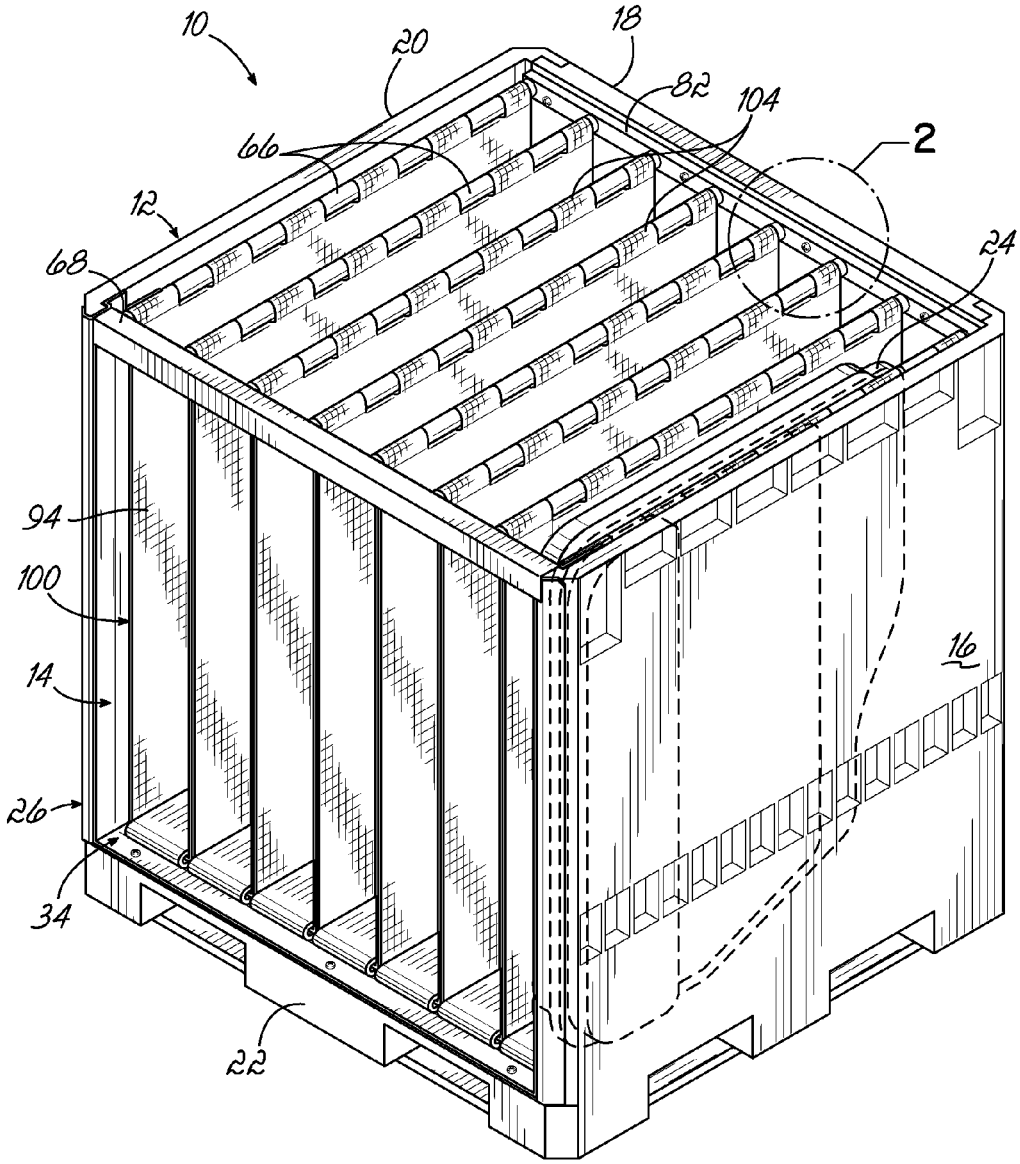
FIG. 1 is a perspective view of a portion of one embodiment of a reusable and returnable container showing one frame, stationary support members and associated dunnage in the form of pouches.

Referring to FIG. 1, there is illustrated a reusable and returnable container 10. The container 10 comprises a body 12 having an open front 14, a side 16, a rear 18 and another side 20. The sides 16, 20 and rear 18 extend upwardly from a base or bottom 22. Although one type of container is illustrated, the present invention may be used with any like type or configuration of container. For example, the present invention may be used in a container in which one or more of the sides of the container are hinged for the container to be more easily erected and/or compacted for storage. For purposes of this document, any of the structures 16, 18 or 20 may be considered side structures or sides or walls or wall structures. One type of container which may be modified in accordance with the present invention is available from the Orbis Corporation of Oconomowoc, Wis.

A cover (not shown) may be included to enclose the open front of container 10 and further protect and secure product 24 (shown in phantom in FIG. 1) during shipment. Although one configuration of product 24 is illustrated and described herein, the present invention may be used to store and ship other configurations of product not shown or described. This document is not intended to limit the type of product being shipped or stored.

Figure 1A:
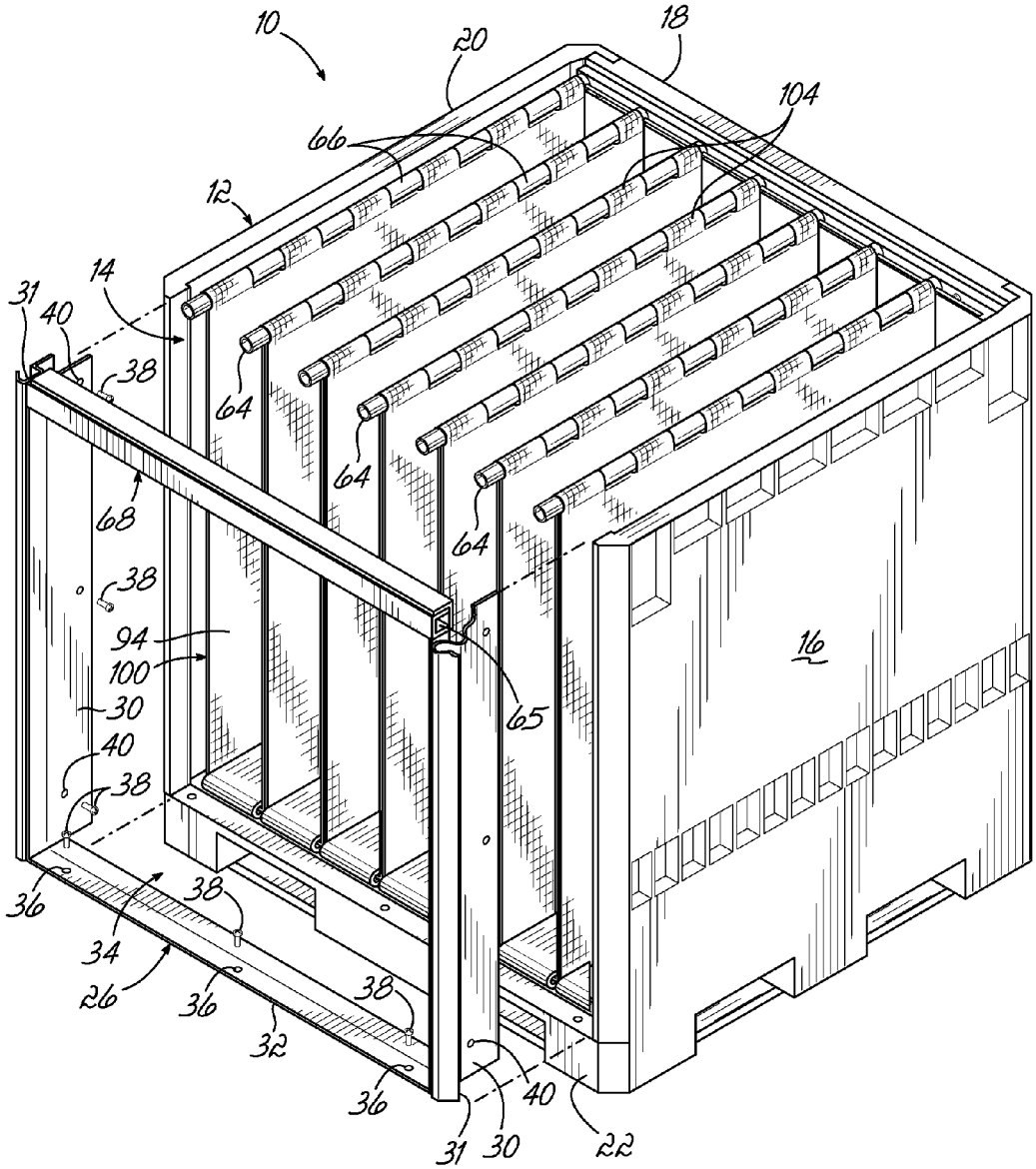
FIG. 1A is a partially disassembled perspective view of the container of FIG. 1.

The front 14 of container 10 comprises a generally rectangular front frame 26, shown separated from the remainder of the container in FIG. 1A. The frame 26 comprises a top channel 28, shown in detail in FIG. 1B, a pair of leg structures 30 and a bottom 32, defining a rectangular opening 34 through which parts or products 24 may be loaded or unloaded. The top channel 28 and bottom 32 extend between the legs or leg structures 30. As best shown in FIG. 1A, each leg 30 has a receiver 31 which receives and retains a portion of one of the sides 16, 20 after assembly. The bottom 32 has a plurality of holes 36 therethrough (only three being shown) to aid in securing the frame 26 to the body 12 of the container 10 and, more particularly, to the base 22 of the body 12 via fasteners 38, as best shown in FIG. 1A. As shown in FIG. 1A, each leg structure 30 of frame 26 has a plurality of holes 40 therethrough (only three being shown) so that the frame 26 may be secured to the body 12 of the container 10 and, more particularly, to the sides 16, 20 of the container body 12 with fasteners 38.

Figure 1B:
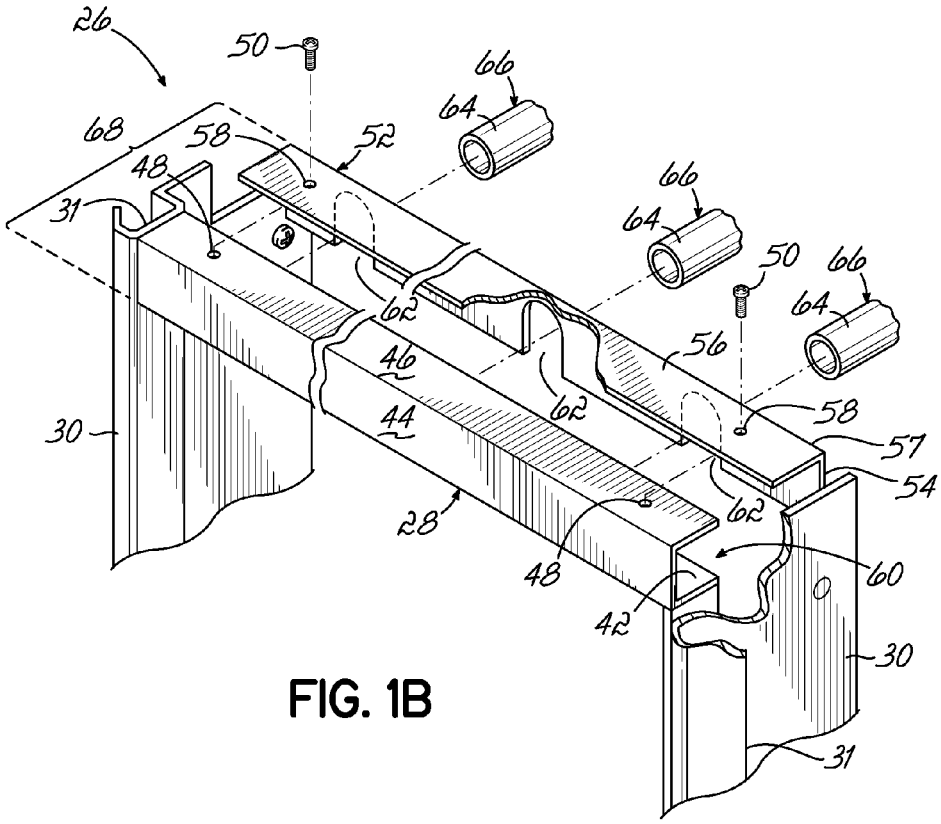
FIG. 1B is an enlarged perspective view of a portion of the container of FIG. 1.

As shown in FIG. 1B, the top channel 28 of the frame 26 comprises a bottom 42, a side 44 and a top 46, which in combination form a C-shaped cross-sectional configuration. The top 46 has a plurality of spaced holes 48 therethrough (only two being shown) adapted to receive fasteners 50 (only two being shown). The fasteners 50 secure a holding bracket 52 to the top channel 28 of the frame 26. As shown in FIG. 1B, the holding bracket 52 comprises a first vertical wall 54 and a second horizontal wall 56 extending outwardly from an upper edge 57 of the holding bracket 52. The second horizontal wall 56 of the holding bracket 52 has a plurality of spaced holes 58 therethrough (only two being shown) adapted to receive fasteners 50. These perpendicular walls 54, 56 give the holding bracket 52 an L-shaped cross-sectional configuration. When the holding bracket 52 is joined to the top channel 28 of the frame 26 with fasteners 50, the second horizontal wall 56 of the holding bracket 52 resides above the top 46 of the top channel 28 of the frame 26 and the first vertical wall 54 covers an open side 60 of the top channel 28 of the frame 26. The fasteners 50 pass through the holes 58 of the second horizontal wall 56 of the holding bracket 52 and through the holes 48 of the top 46 of the top channel 28 of the frame 26.

The first vertical wall 54 of the holding bracket 52 has a plurality of spaced cut-outs 62, each cut-out 62 being generally U-shaped. Each cut-out 62 is sized to receive and retain an end portion 64 of a support member 66. The end portion 64 of support member 66 resides inside the interior of the assembled front holder 68 of the frame 26 when the container is fully assembled. When the holding bracket 52 is secured to the top channel 28 of the frame 26, the frame 26 has a front holder or upper horizontal member 68 extending between leg structures 30. The front holder 68 has a generally rectangular cross-sectional configuration with a hollow interior 65, as shown in FIG. 1A.

Figure 1C:
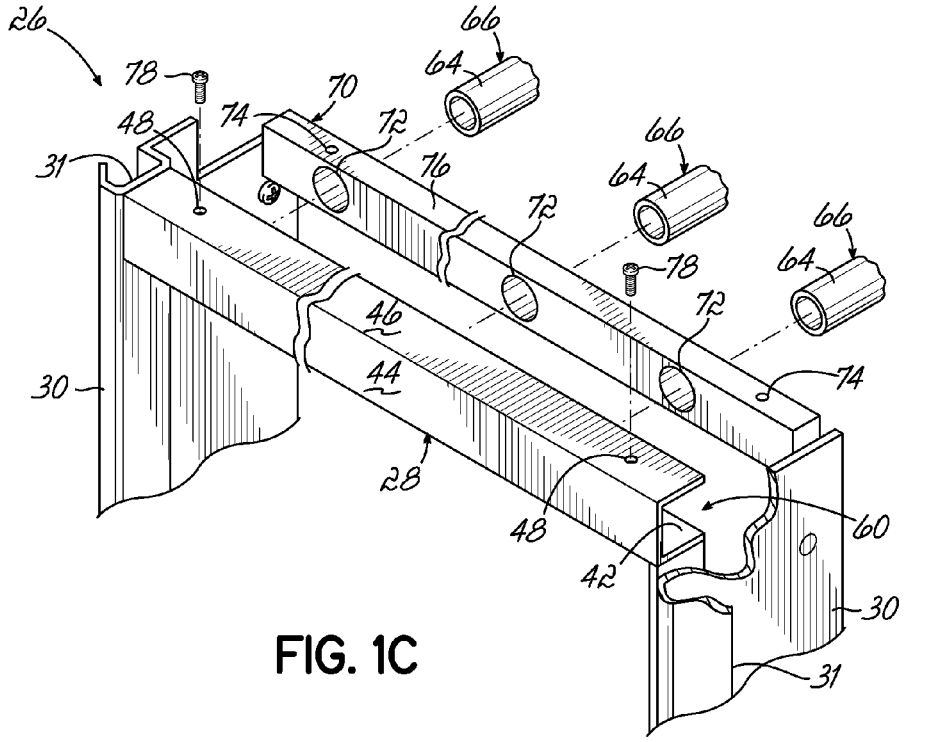
FIG. 1C is an enlarged perspective view of a portion of an alternative embodiment of container.

FIG. 1C illustrates an alternative embodiment of front holder which may be used in any embodiment of container shown or described herein. In this embodiment, the front holder 70 comprises a solid member having a plurality of spaced openings 72 therethrough (only three being shown). The front holder 70 has a plurality of spaced holes 74 (only two being shown) extending downwardly from an upper surface 76 of the front holder 70. Fasteners 78 (only two being shown) secure the front holder 70 to the top channel 28 of the frame 26, such that the front holder 70 resides therein. The fasteners 78 secure the front holder 70 in place within the interior of the top channel 28 of the frame 26. The end portions 64 of support members 66 reside inside the interior (inside openings 72) of the assembled front holder 70 of the frame 26 when the container is fully assembled.

Figure 2:
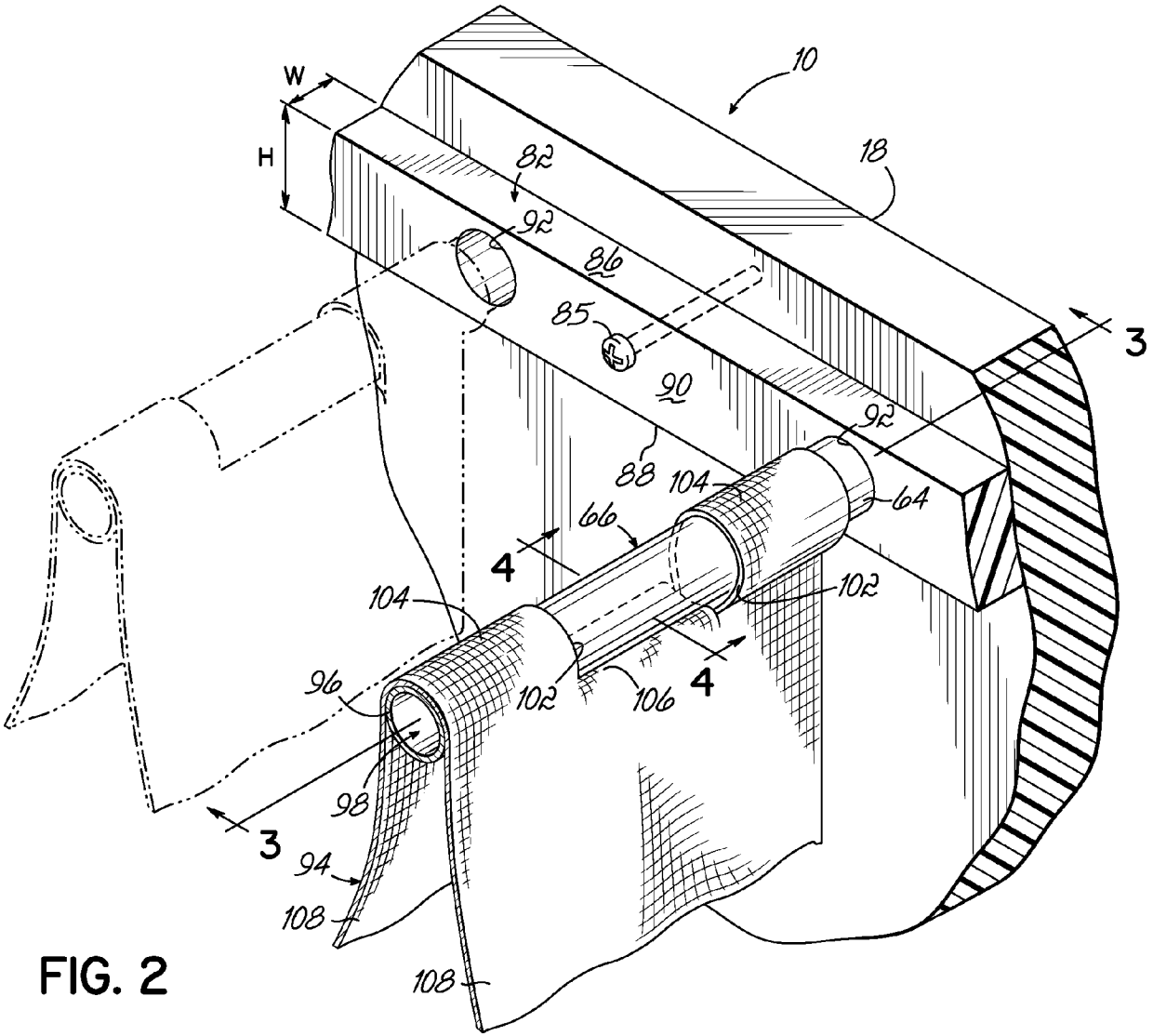
FIG. 2 is a perspective view of the encircled area 2 of FIG. 1.

FIG. 2 shows the details of the rear of container 10. As shown in FIGS. 1 and 2, a rear holder 82 is secured to the rear 18 of the container 10 with any number of fasteners 85, such as bolts (only one being shown). However, the rear holder 82 may be secured in any known fashion to the rear 18 of the container 10, including through the use of any number of fasteners. The rear holder 82 has upper and lower surfaces 86, 88 defining a height "H" therebetween. Similarly, rear holder 82 has opposed side surfaces 90 defining a width "W" therebetween. Thus, the rear holder 82 has a generally rectangular cross-sectional configuration. The rear holder 82 has a plurality of spaced openings 92 therein which may or may not extend entirely through the rear member 82. Each of these openings 92 is sized and adapted to receive and retain an end portion 64 of a support member 66. The rear member 82 thus provides support for the support members 66 and keeps them stationary or fixed in a predetermined location, in combination with the front holder. Although one configuration of rear holder 82 is illustrated and described, the rear holder may assume other configurations or shapes, like the one shown in FIG. 9. In one embodiment, the rear holder 82 is made of wood, but may be made of any desired material.

Figure 3:
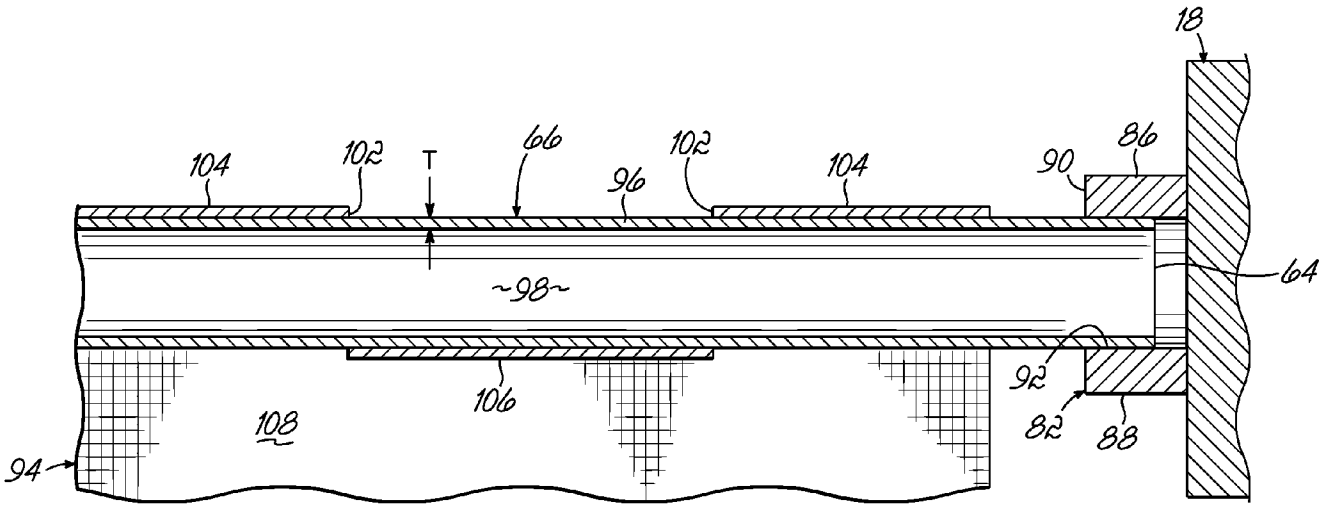
FIG. 3 is a cross-sectional view taken along the line 3-3 of FIG. 2.
Figure 4:
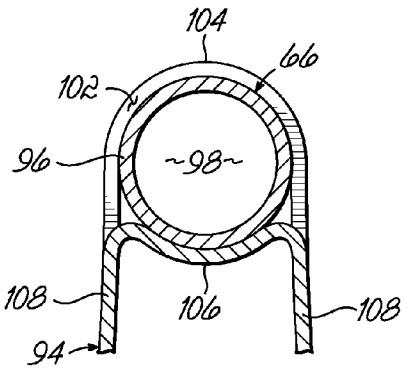
FIG. 4 is a cross-sectional view taken along the line 4-4 of FIG. 2.

FIG. 1 illustrates a plurality of stationary support members 66, each support member 66 being a unitary member and extending between front and rear holders 68, 82 at the same level or height. The front and rear holders 68, 82 support the weight of the support members 66 and associated dunnage 94, as described below. FIGS. 2 and 3 illustrate a portion of one of the support members 66. Support members or cross members 66 may be made of metal or plastic, such as polyvinyl chloride, known as PVC. As shown in FIGS. 2, 3 and 4, each support member 66 has a wall 96 of a thickness "T" and a hollow interior 98. As best shown in FIGS. 2 and 3, each support member 66 at each end has an end portion 64 located inside one of openings of one of the holders. The size and/or configuration of the holder openings, support members or end portions thereof is not intended to be limited by the drawings of this document. As shown in FIG. 3, the rear end 64 of tubular support member 66 is located inside an opening 92 of the rear holder 82. Similarly, a front end 64 of tubular support member 66 is located inside the interior 65 of the front holder 68 through one of the cut-outs 62 in the holding bracket 52.

The dunnage 94 may comprise one or more pieces of dunnage material. The material may be a textile material, such as polyester. However, this document is not intended to limit the size or material of the dunnage. The drawings show the dunnage 94 supported by the support members 66 being in the form of pouches 100. Two adjacent support members 66 support a pouch 100. Each pouch 100 may be made from one piece of material or multiple pieces of material. As best shown in FIG. 2, the dunnage 94 or pouches 100 may be supported by the support members 66 without the need for any sewing or welding. The elimination or reduction of sewing or welding reduces the cost of assembly and therefore, reduces the price of a container equipped with dunnage and ready to use.

As best shown in FIGS. 2 and 3, the dunnage material has a plurality of spaced cuts 102 (only one pair being shown in FIG. 2) which enable one of the support members 66 to be threaded through the dunnage material. As shown in FIG. 3, the result of such a process of securing the dunnage material to one of the support members 66 is that portions 104 of the dunnage material reside above the support member 66, and other portions 106 of the dunnage material reside below the support member 66. The dunnage 94 is thereby secured to the support member 66 without any material being removed from the dunnage and without the need for sewing or bonding or welding the dunnage to itself to form a receiver for the support member. Two sides 108 of the piece of dunnage material extend downwardly from each of the support members 66 and form part of the pouches 100.

Figure 2A:
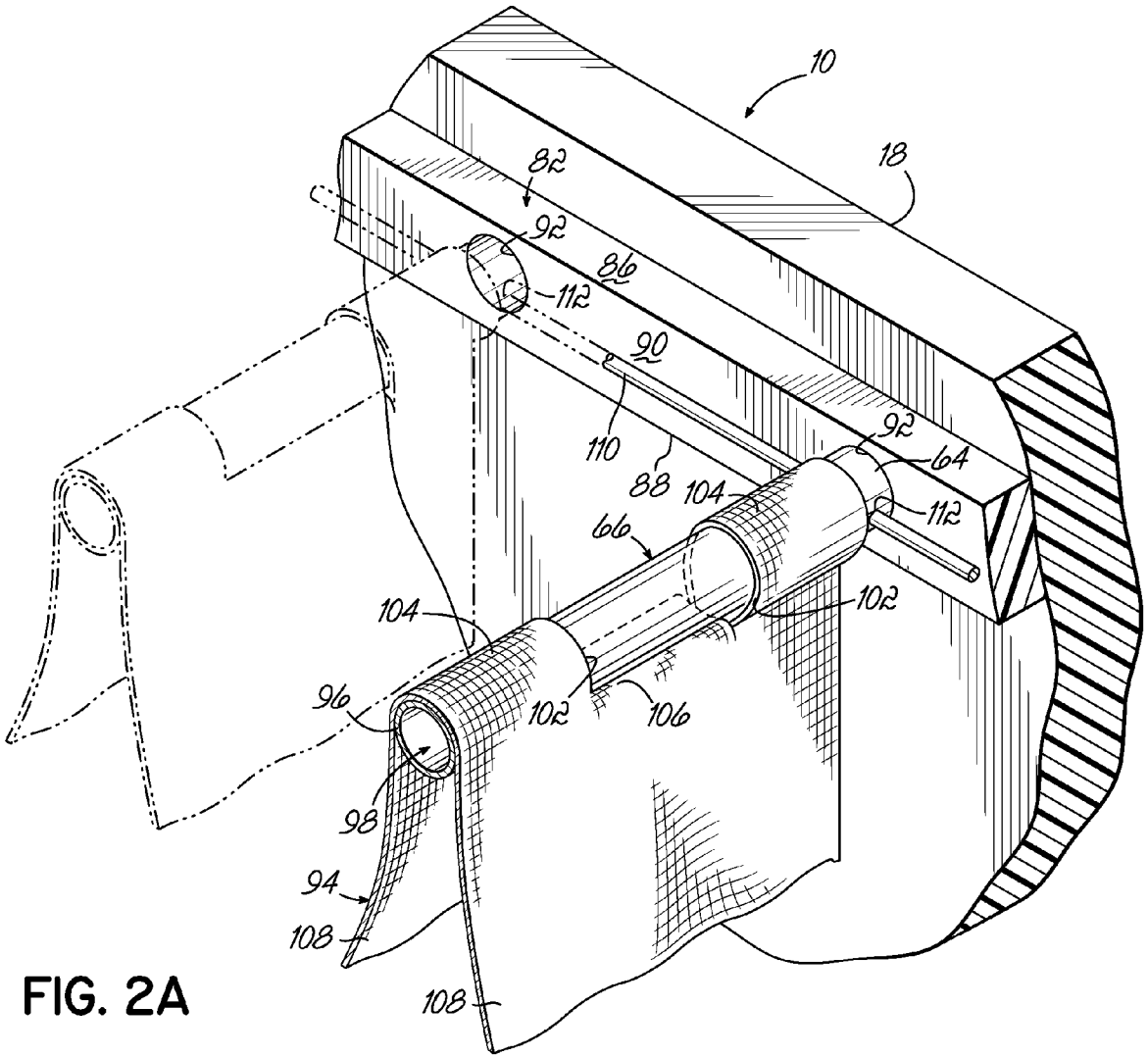
FIG. 2A is an enlarged perspective view of a portion of an alternative embodiment of container.

FIG. 2A shows the container 10 of FIGS. 1 and 2, but with the addition of a stabilizer 110 in the form of a wire. The stabilizer 110 extends along the rear of the container 10 and passes through holes 112 in the support members 66. The stabilizer 110 helps prevent the support members 66 from rotating. The stabilizer 110 is shown in FIG. 2A located along the rear of the container; however another stabilizer may be used to stabilize or inhibit rotation of the support members 66 at the front of the container. This document does not intend to limit the stabilizer to wire; it may be made of any suitable material and any shape which inhibits or impedes rotation of the support members 66.

Figure 5:
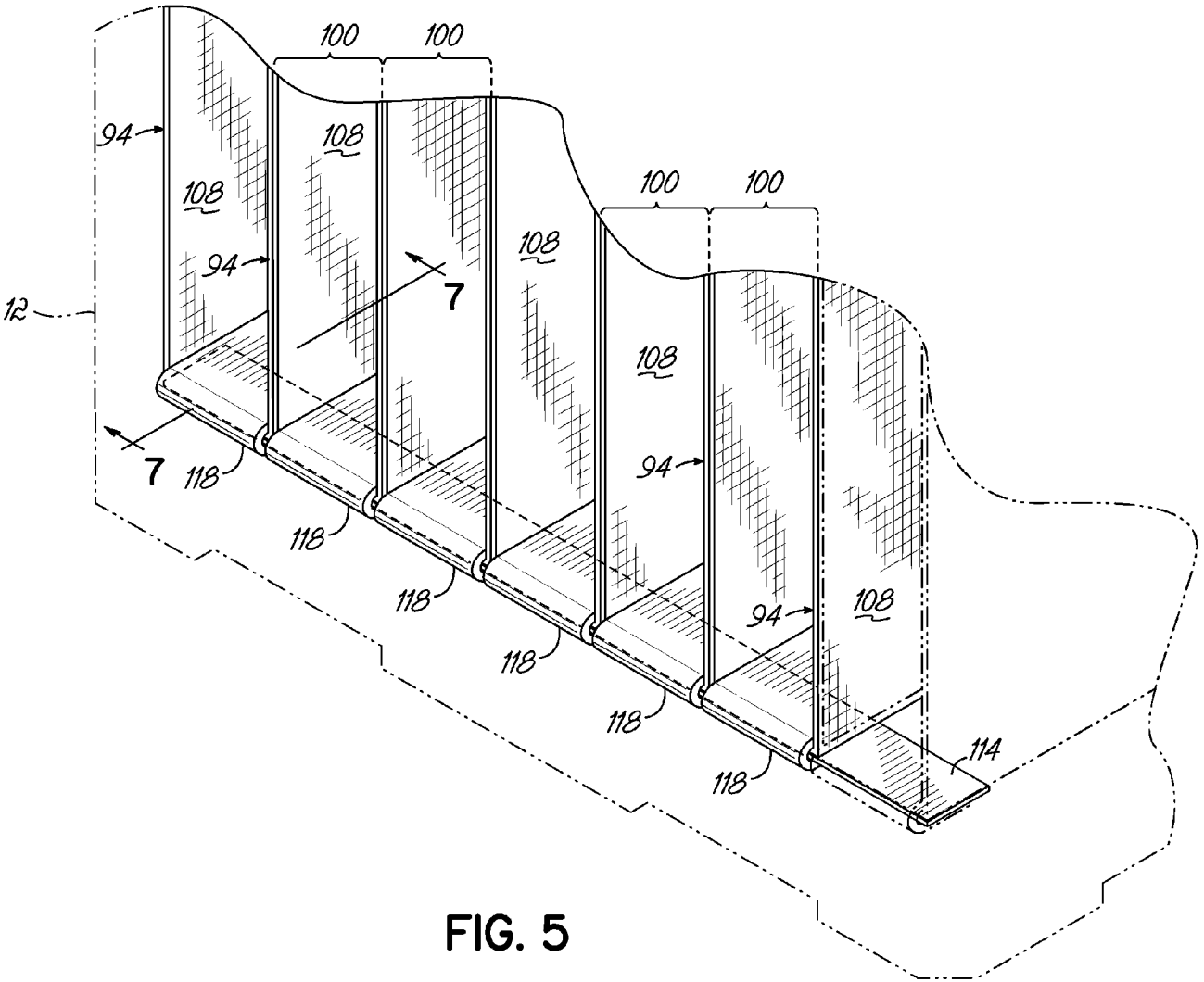
FIG. 5 is a perspective view of a portion of the container of FIG. 1.
Figures 6, 7:
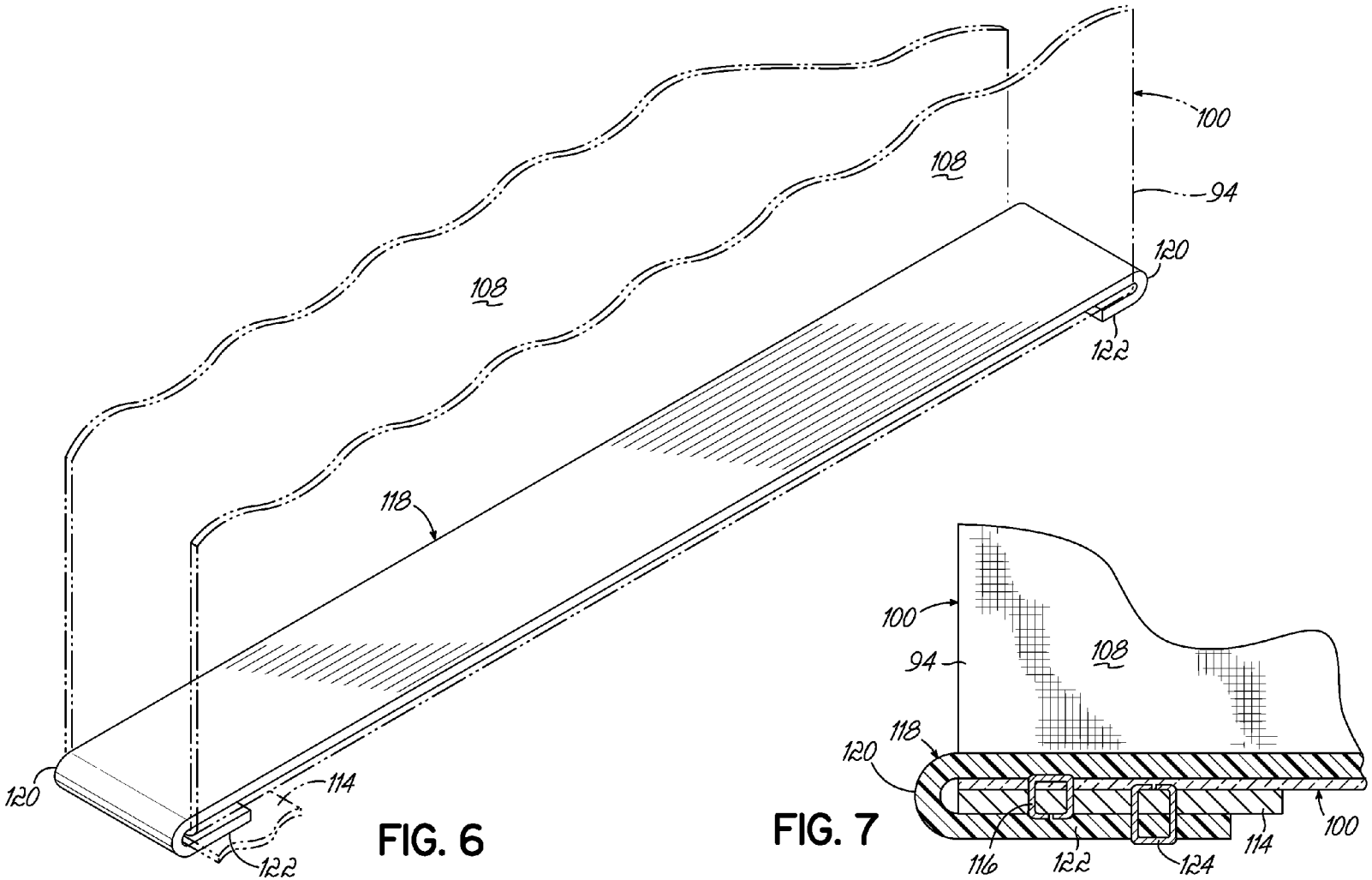
FIG. 6 is a perspective view of a portion of the container of FIG. 1.
FIG. 7 is a cross-sectional view taken along the line 7-7 of FIG. 5.

FIGS. 5, 6 and 7 illustrate the bottom of the dunnage 94 as it resides inside the container 10. As shown in FIGS. 5, 6 and 7, a locking strip 114 may be secured via staples 116 to each pouch 100 such that the locking strip 114 is below the pouch 100. Thus, the pouches 100 are maintained in a desired position and move together rather than independently. This is particularly important during the shipping process because the pouches 100 may be used to store for shipment large and potentially heavy objects, such as car door panels, for example. During shipment, it is undesirable for one loaded pouch to hit an adjacent loaded pouch because one or more of the products therein may be damaged.

As shown in FIGS. 6 and 7, a stiffener 118 may be located inside each pouch 100 at the bottom of the pouch 100. The stiffener 118 has a bent or curved end 120 at each end thereof and is doubled back on itself with a lower lip 122 at each end. Each lower lip 122 is located below the locking strip 114 and pouch 100, as shown in FIG. 7. Each stiffener 118 is secured in place with staples 124 at each end.

Figure 8:
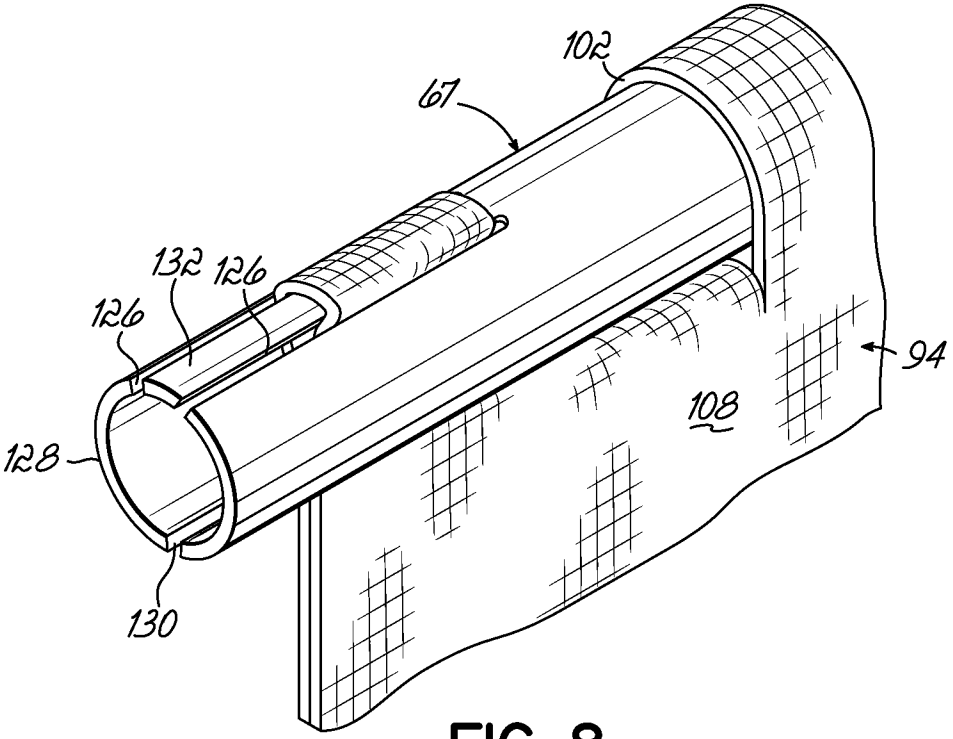
FIG. 8 is a perspective view of a portion of a container in accordance with the present invention showing one way of securing dunnage to support members.

FIG. 8 illustrates an alternative method of securing dunnage 94 to one of the support members. According to this aspect of the invention, each support member 67 has at each end spaced two slots 126 at the top of the support member 67 extending inwardly from an outer edge 128 of the support member 67 and defining a lip 132 therebetween. Support member 67 also has a bottom slot 130 extending inwardly from outer edge 128 of support member 67. During the assembly process, the dunnage 94 is slid through the slots 126, such that the dunnage material is looped over the top of the lip 132. Both sides 108 of pouch 100 pass through the bottom slot 130 and hang downwardly, as shown in FIG. 8.

Figure 9:
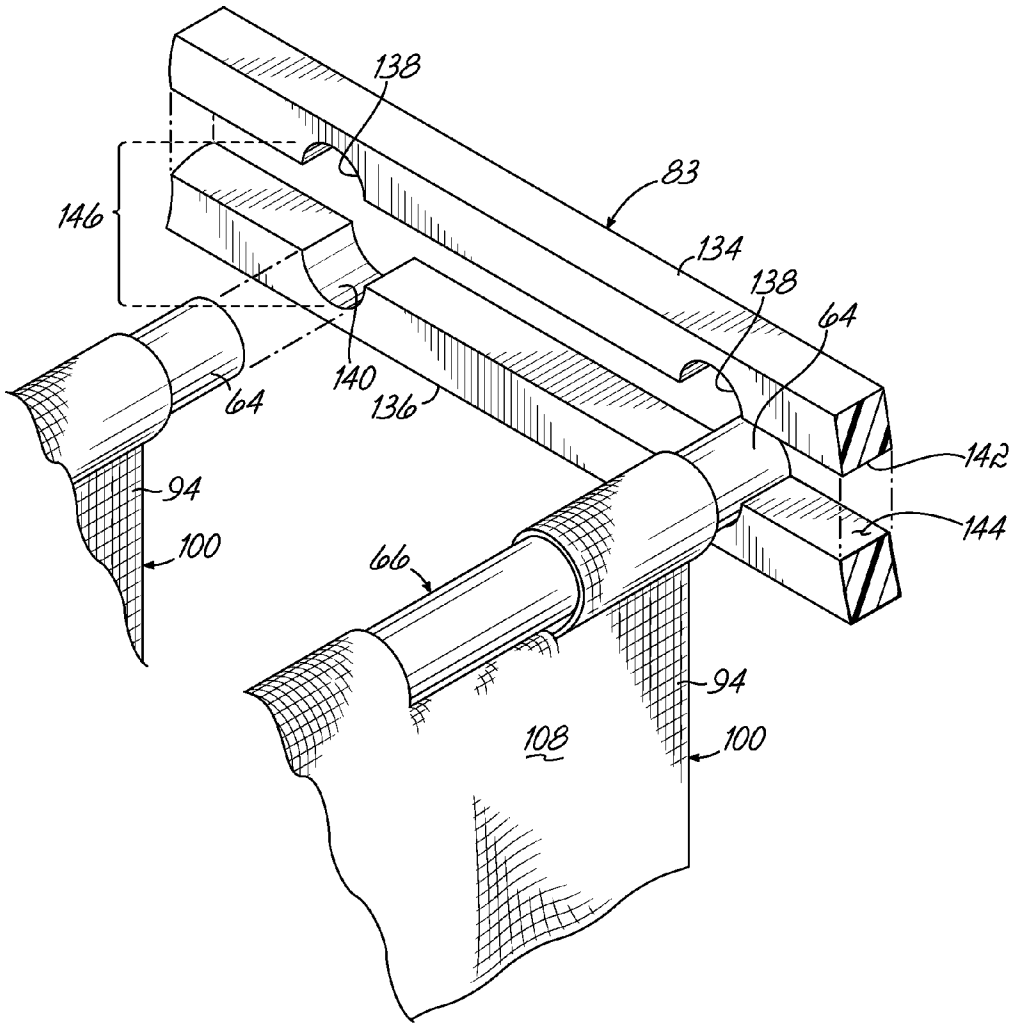
FIG. 9 is a perspective view of a portion of a container in accordance with the present invention showing another type of holder to secure support members in place.

FIG. 9 illustrates an alternative form of rear holder 83 made up of two pieces 134, 136. Upper piece 134 has a plurality of spaced openings 138 removed therefrom. Similarly, lower piece 136 has a plurality of spaced openings 140 removed therefrom. These openings 138, 140 are shown as semicircles, but may assume other shapes. When the upper and lower pieces 134, 136 are combined such that the lower surface 142 of upper piece 134 contacts upper surface 144 of lower piece 136, the openings 138, 140 combine to form openings 146 sized to receive end portions 64 of support members 66.

FIGS. 10-13B illustrate an alternative embodiment of container 10*a*. Container 10*a* is identical to container 10, except the dunnage. For simplicity, like parts have the same numbers. The container 10*a* comprises a body 12 having an open front 14, a side 16, a rear 18 and another side 20, the sides and rear extending upwardly from a base or bottom 22.

Figure 10:
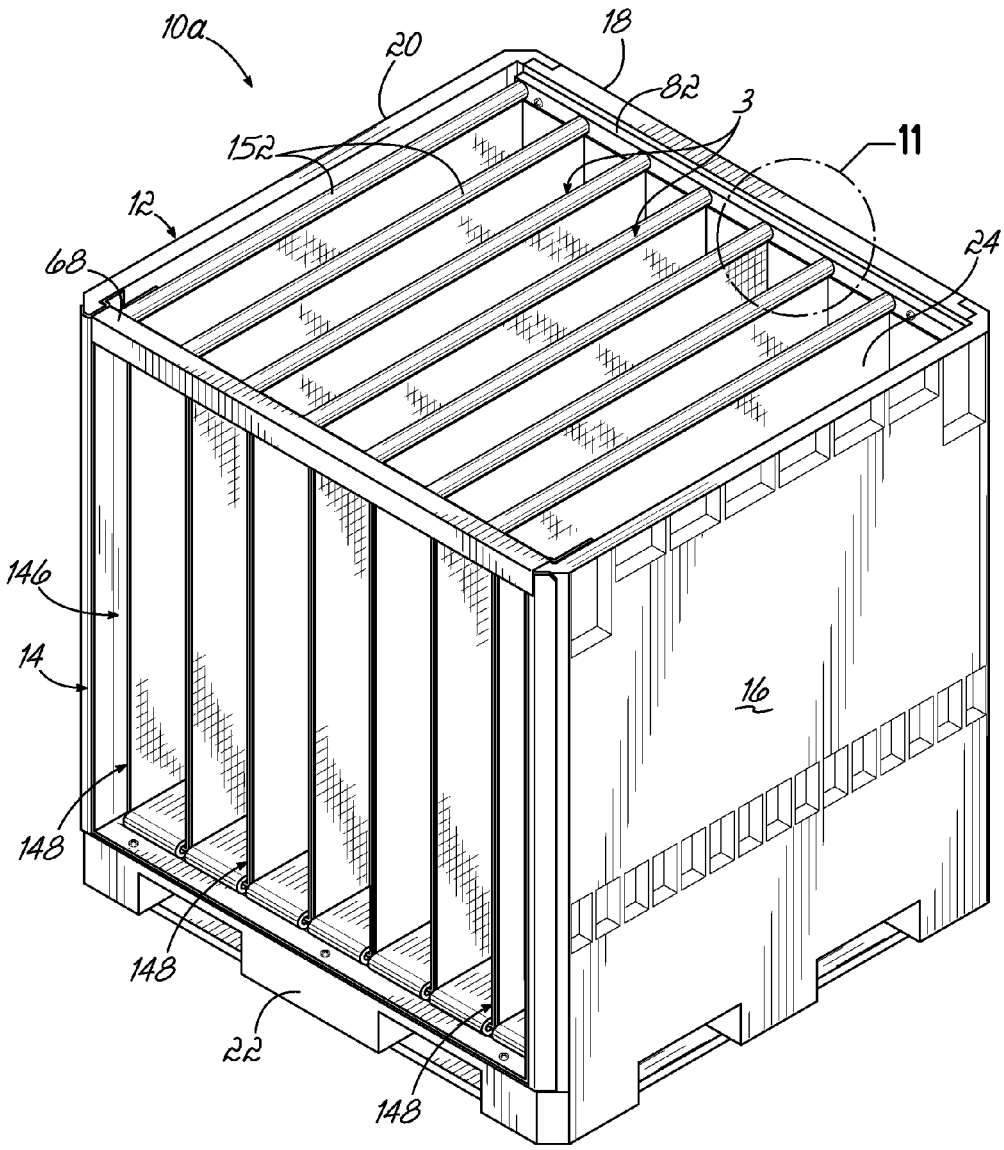
FIG. 10 is a perspective view of a portion of an alternative embodiment of reusable and returnable container.
Figure 11:
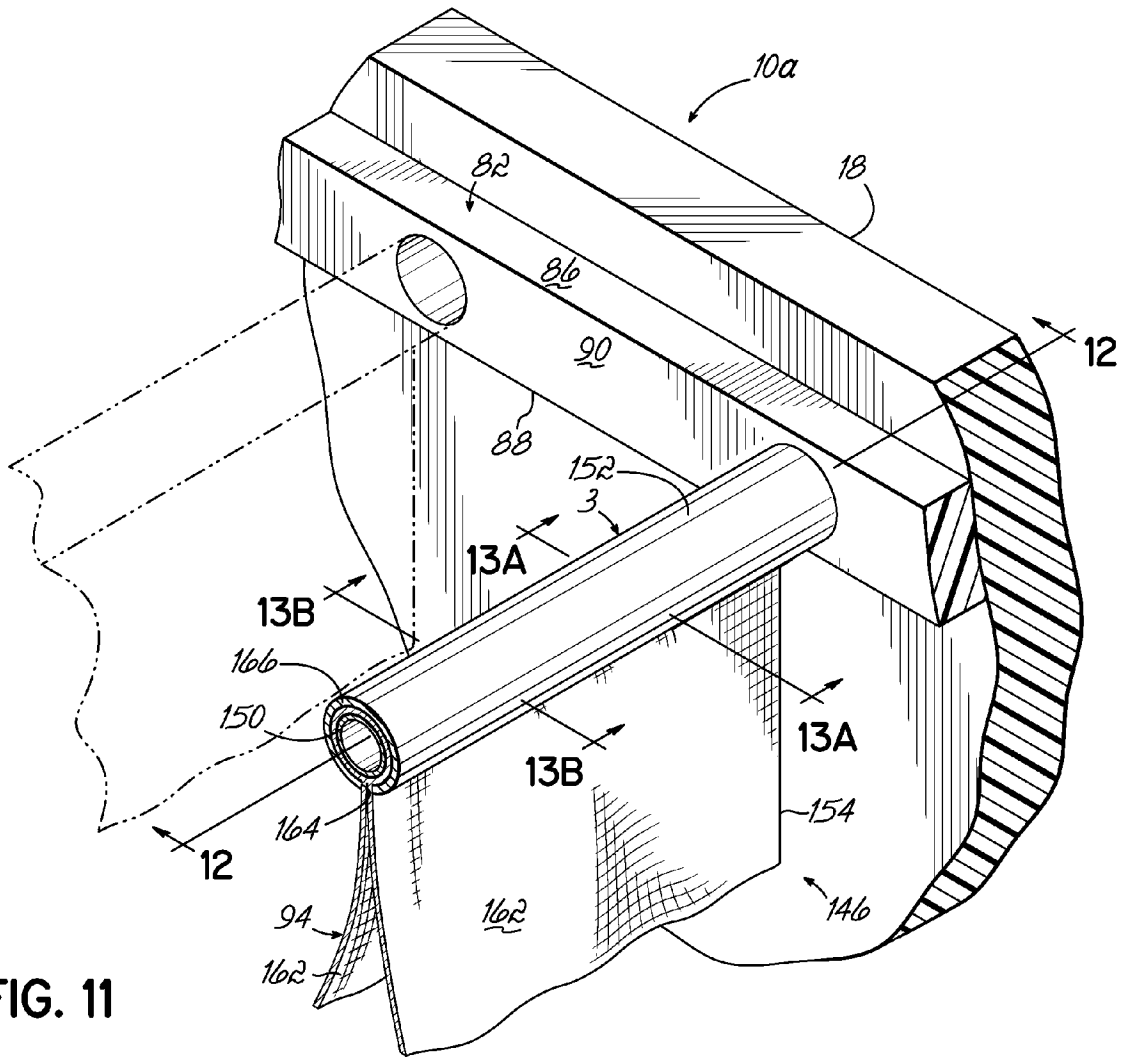
FIG. 11 is a perspective view of the encircled area 11 of FIG. 10.
Figure 12:
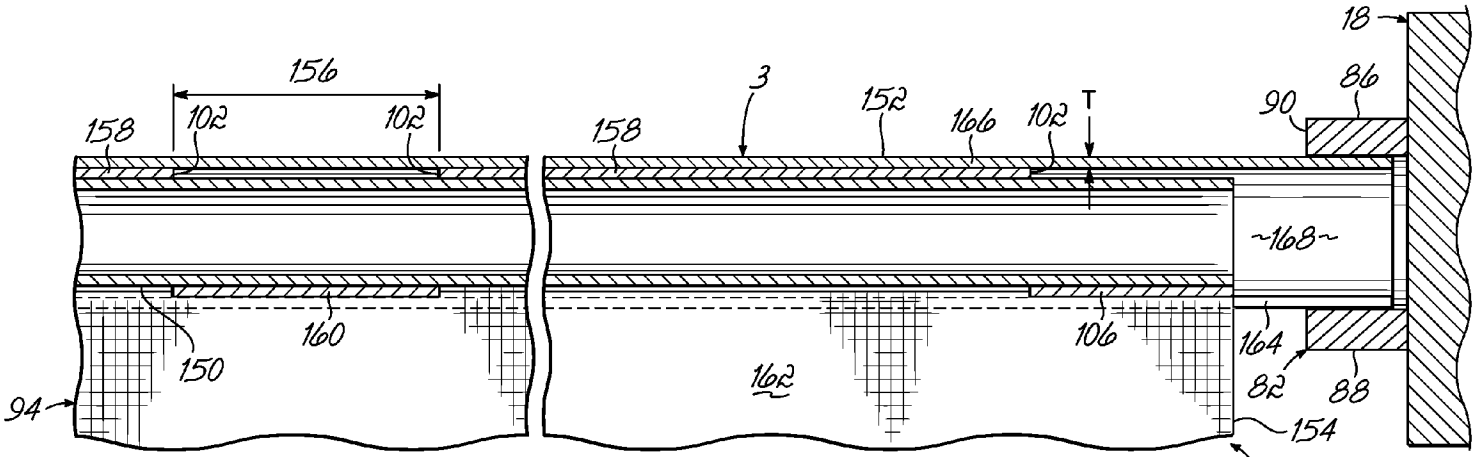
FIG. 12 is a cross-sectional view taken along the line 12-12 of FIG. 11.
Figure 13B:
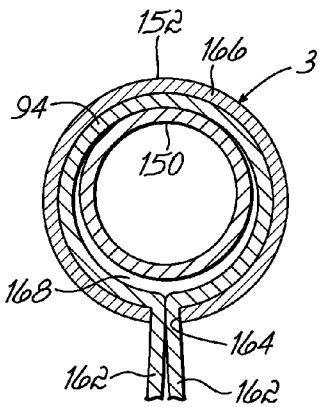
FIG. 13B is a cross-sectional view taken along the line 13B-13B of FIG. 11.
Figure 13A:
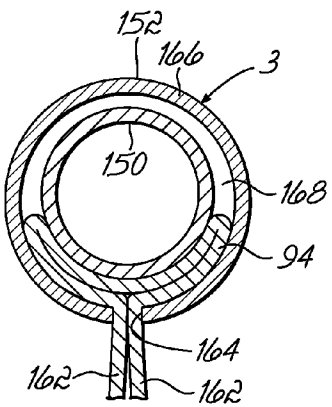
FIG. 13A is a cross-sectional view taken along the line 13A-13A of FIG. 11.
Figure 14:
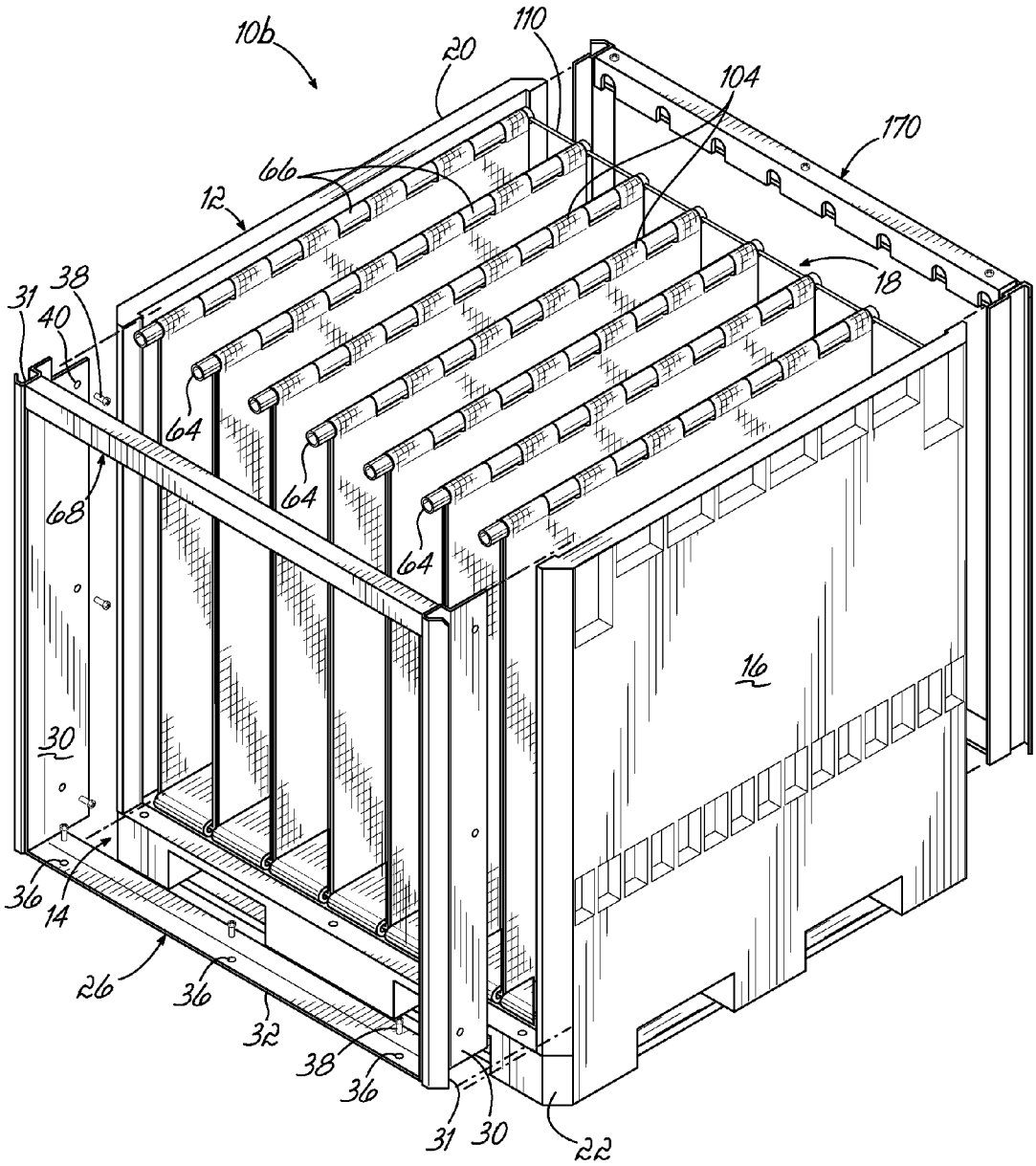
FIG. 14 is a partially disassembled perspective view of alternative embodiment of container.

FIGS. 10-13B illustrate a dunnage system 146 which is not intended to be limited to any particular container and may be used in any container or embodiment shown or described herein, including the container shown in FIG. 14. As best shown in FIG. 10, the dunnage system 146 comprises one level or layer of stationary support assemblies 3 and associated dunnage in the form of pouches 148. As best shown in FIGS. 11, 12, 13A and 13B, each support assembly 3 includes an inner tubular member 150 and an outer tubular support member 152 with dunnage material therebetween. Each of the inner tubular members 150 has a length less than the width of the container. The inner tubular members 150 are not engaged with the holders and may be made from plastic, aluminum or any other metal or material. Each of the outer tubular members 152 has a length greater than the width of the container and has end portions inside the holders of the container 10*a*, as shown in FIGS. 11 and 12. The outer tubular members 152 are engaged with the holders and may be made from plastic, aluminum or any other metal or material.

As best shown in FIG. 12, at approximately the middle of each of the stationary support assemblies 3, the dunnage material has a pair of spaced cuts 102 which enable one of the inner tubular members 150 to be threaded through the dunnage material. In addition, a single cut 102 is made in the dunnage material a short distance (about an inch or so) away from each of its outer edges 154 which enables the dunnage material to be tucked underneath the inner tubular member 150 at each end, as shown in FIG. 13A. The inner tubular member 150 is then woven through the cuts 102 in the piece of dunnage material so that the dunnage material resides underneath the inner tubular member 150 at each end of the inner tubular member 150 (see FIG. 13A) and along one section 156 proximate the middle of the inner tubular member 150. As shown in FIG. 12, the result of such a process of securing the dunnage material to one of the inner tubular members 150 is that portions 158 of the dunnage material reside above the inner tubular member 150, and other portions 160 of the dunnage material reside below the inner tubular member 150. The dunnage material is thereby secured to the inner tubular member 150 without any material being removed from the dunnage material and without the need for any sewing or bonding or welding of the dunnage material. Two sides 162 of the piece of dunnage material extend downwardly from each of the inner tubular members 150 and form sides of the dunnage pouches 148. Another advantage of this dunnage system is that the dunnage material does not rotate around the inner tubular members 150 when parts are loaded into pouches 148.

The dunnage system 146 further comprises a plurality of outer tubular support members 152. Each outer tubular support member 152 is a unitary member and extends between front and rear holders 68, 82 at the same level or height. The front and rear holders 68, 82 support the weight of the outer support members 152, inner tubular members 150 and associated dunnage pouches 148. Outer support members 152 may be made of metal or plastic, such as polyvinyl chloride, known as PVC. Each tubular support member 152 has a wall 166 of a thickness "T" and a hollow interior 168 inside which resides the inner tubular member 150 and portions of dunnage 94. As shown in FIG. 12, each tubular support member 152 has a groove 164 extending the length of the support member 152. As shown in FIG. 11, groove 164 cuts through the tubular support member 152 and enables the dunnage material attached to inner tubular member 150 to pass through the outer tubular support member 152 and hang downwardly from the inner tubular members 150. As best shown in FIG. 12, each inner support member 150 is located inside the interior of one of the outer tubular support members 152.

FIG. 14 illustrates an alternative embodiment of container 10*b*. Container 10*b* is identical to container 10, except the rear. For simplicity, like parts have the same numbers. The container 10*b* comprises a body 12 having an open front 14, a side 16, an open rear 18 and another side 20, the sides 16, 20 and rear 18 extending upwardly from a base or bottom 22. The rear 18 comprises a rear frame 170 identical to front frame 26 rather than a wall or similar structure. The rear frame 170 is attached to the base 22 and sides 16, 20 in the same manner that front frame 26 is secured to the same. The rear frame 170 enables product to be loaded or unloaded from the rear as well as the front. The container 10*b* may have any dunnage system shown or described herein. A container like container 10*b* having front and rear frames may be incorporated into any embodiment shown or described herein. In other words, any of the features shown or described herein may be mixed and matched in any combination without departing from the spirit of the invention.

While various embodiments of the present invention have been illustrated and described in considerable detail, it is not the intention of the applicant to restrict or in any way limit the scope of the claims to such detail. Additional advantages and modifications will readily appear to those skilled in the art. The invention in its broader aspect is, therefore, not limited to the specific details, representative system, apparatus, and method, and illustrative example shown and described. Accordingly, departures may be made from such details without departing from the spirit or scope of the applicant's general inventive concept.

What is claimed is:

1. A container for holding product therein during shipment, the container comprising:

a body having a bottom, two sides and a rear;

a frame extending between the sides;

a front holder supported by the frame;

a rear holder supported by the body;

a plurality of tubular support members, each of the support members being held stationary by the front and rear holders and extending therebetween; and dunnage in the form of pouches, each of the pouches being supported by two of the support members wherein the dunnage is slotted, each of the two support members being woven through the slots of the dunnage, portions of the dunnage being above the support member and other portions of the dunnage being below the support member and two sides of the dunnage extending downwardly on opposite sides of the support member and being joined in a bottom portion of the pouch.

2. The container of claim 1 further comprising a stabilizer passing through holes in the support members to prevent rotation of the support members.

3. The container of claim 2 wherein each of the pouches has a stiffener secured inside the pouch at the bottom portion of the pouch.

4. The container of claim 3 wherein the stiffener is bent at each end, the material of the pouch between sandwiched therebetween.

5. The container of claim 1 wherein the front holder is secured inside a channel of the frame.

6. The container of claim 5 wherein the rear holder is secured to the rear.

7. The container of claim 1 wherein end portions of the support members are located inside the holders.

8. The container of claim 2 wherein the support members are tubular.

9. The container of claim 2 wherein the pouches are slotted, the support members being woven through the slots of the pouches.

10. A container for holding product therein during shipment, the container comprising:

a body having a bottom, a rear structure and two side structures extending upwardly from the bottom;

a front frame secured to the side structures of the body;

a front holder secured to a portion of the front frame;

a rear holder supported by the body;

tubular support members extending between and supported by the holders; and pouches supported by the support members, each of the pouches having a stiffener secured inside the pouch at the bottom portion of the pouch, the stiffener having curved ends, each curved end terminating in a lower lip located below the pouch.

11. The container of claim 10 further comprising a locking strip to which the pouches are secured.

12. The container of claim 11 wherein said locking strip is located inside the curved ends of the stiffeners.

13. The container of claim 12 wherein the pouches are slotted, the support members being woven through the slots of the pouches.

14. The container of claim 12 wherein upper portions of the pouches are slotted, the support members being woven through the slots of the pouches.

15. A container for holding product therein during shipment, the container comprising:

a body having a bottom and two side structures;

front and rear rectangular frames supported by and extending between the side structures;

holders secured to the frames;

a plurality of tubular support members extending between the holders; and pouches supported by the support members, at least one of the pouches having a stiffener secured inside the pouch at the bottom of the pouch, the stiffener having curved ends, each curved end terminating in a lower lip located below the pouch.

16. The container of claim 15 further comprising a locking strip to which the pouches are secured.

17. The container of claim 16 wherein the pouches are slotted, the support members being woven through the slots of the pouches.

18. The container of claim 16 wherein upper portions of the pouches are slotted, the support members being woven through the slots of the pouches.

19. The container of claim 18 wherein the tubular support members are plastic.

20. The container of claim 18 wherein the tubular support members are metal.

* * * * *